United States Patent [19]

Young et al.

[11] Patent Number: 4,906,201

[45] Date of Patent: Mar. 6, 1990

[54] ELECTRICAL CONNECTOR MOUNTING APPARATUS WITH EMI SHIELDING

[75] Inventors: John W. Young; Brian G. Heintz, both of Portland, Oreg.

[73] Assignee: Tektronix, Inc., Beaverton, Oreg.

[21] Appl. No.: 356,906

[22] Filed: May 25, 1989

[51] Int. Cl.[4] ..... H01R 13/648

[52] U.S. Cl. ..... 439/108; 439/554; 439/567; 439/609; 29/832

[58] Field of Search ..... 439/92, 95, 108, 544, 439/554, 557, 563, 564, 567, 607, 609; 29/831, 832, 842

[56] References Cited

U.S. PATENT DOCUMENTS 4,643,509 2/1987 Hollyday et al. ..... 439/607

4,822,286 4/1989 Bianca ..... 439/610 X

FOREIGN PATENT DOCUMENTS 2613907 10/1977 Fed. Rep. of Germany ..... 439/607

*Primary Examiner*—Eugene F. Desmond

*Attorney, Agent, or Firm*—William K. Bucher

[57] ABSTRACT

An electrical connector mounting apparatus has an electrically conductive member formed with spring biased fingers, a base portion and a fastening member. The spring biased fingers in conjunction with the base portion provide electrical continuity between the base of the electrical connector and a chassis frame when the connector is inserted into a frame opening. The base portion of the electrically conductive member is captured between the base of the electrical connector and a support member, which prevent excessive connector rotation and provides strain relief between the base portion and the fastening member. The fastening member is spring biased and engages the frame opening during the insertion of the electrical connector into the frame.

17 Claims, 2 Drawing Sheets

ELECTRICAL CONNECTOR MOUNTING APPARATUS WITH EMI SHIELDING

BACKGROUND OF THE INVENTION

The present invention is directed to a mounting apparatus for electrical connectors and more specifically to a mounting apparatus providing a grounding path between the electrical connector and a chassis for electromagnetic interference shielding.

RS232 electrical connectors are widely used in the electronic industry as hardware interfaces for connecting various types of electronic equipment. In particular, D-type subminiature RS232 connectors are used as serial ports in computers, display terminals, workstations, and the like. One type of D-type subminiature connector has an electrically conductive base and a raised connector portion containing male or female electrical contacts, which mate with opposite type contacts in a corresponding connector. Generally, a connector of this type is inserted into an opening in the electronic equipment chassis and secured to the chassis by screw, lock washer, and nut assemblies on each side of the raised connector portion. Pins connected to the electrical contacts and extending from the opposite side of the raised connector portion are soldered to a circuit board containing electronic circuitry and a ground plane. Electrically conductive brackets connected to the base of the electrical connector on the same side as the pins provide electrical continuity between the base and the circuit board ground plane, which is in electrical contact with the chassis.

Attempts have been made to eliminate the tedious and time-consuming task of securing these type of electrical connectors into chassis openings. One such prior art device consists of a molded plastic housing having a spring steel clip affixed thereto. The housing is screwed to the base of the electrical connector adjacent to each end of the raised connector portion. The housing has shouldered extensions adjacent to its base that are captured between the base of the electrical connector and the frame providing a firm seat for the connector. The spring steel clip is swedged into a depression formed in the top of the housing and has a portion extending outward from and bent downward toward the base of the electrical connector. The portion of the clip extending outward from the base has a shoulder formed therein that engages and secures the electrical connector in the chassis frame as the electrical connector is inserted into the opening. One drawback to this type of design is that the spring steel clips have to be depressed by hand or with a tool to disengage the shoulder from the chassis frame. A further and more serious drawback of this design is that the shouldered extensions on the housing prevents the base of the electrical connector from contacting the frame causing a loss of electrical continuity there between permitting conducted or radiated electro-magnetic interference (EMI) to occur.

To reduce EMI problems at a connector interface, the largest conductive surface area possible is used for grounding the connector to the chassis and the ground plane of the circuit board. For a D-type subminiature connector, the electrically conductive metal base provides a good grounding surface between the chassis and the connector. Metal brackets connect the base of the connector to the ground plane of the circuit board. In addition, an electrically conductive shell, generally of metal, surrounds the raised connector portion of the connector. In mating two D-type subminiature connectors together, the metal shell of one connector slidably engages the other shell. Various methods have been used to maintain the electrical continuity between the two connector shells. One method has been to provide outward protruding dimples on the mating surfaces of the shells. Another method, as exemplified in the D*U series socket connector marketed by ITT-Cannon, provides grounding springs mounted on the sides of the inner mating metal shell. The grounding springs are in the form of individual metal fingers that are depressed and captured between the mating connector shells. The above described grounding methods are directed to maintaining electrical continuity between two mating electrical connectors and not to maintaining electrical continuity between an electrical connector and a chassis frame.

What is needed is a fastening apparatus that can quickly and easily secure an electrical connector into a frame opening in an electrical chassis while at the same time providing good electrical continuity between the electrical connector and the frame preventing electromagnetic interference problems.

SUMMARY OF THE INVENTION

A ground clip and fastening apparatus for securing an electrical connector in a frame opening has a support member fixedly positioned on a base portion of the electrical connector adjacent to an end surface of a raised connector portion of the electrical connector. An electrically conductive member having a base portion is captured between the support member and the base of the electrical connector. Spring biased fingers are integrally formed to the base portion of the electrically conductive member to provide electrical continuity between the base of the electrical connector and the chassis frame. Each spring biased finger angularly depends from the base of the electrical connector and has an end portion depending toward the base with at least one finger extending along each side of the raised connector portion. A securing means is integrally formed from the electrically conductive member opposite the spring biased fingers and depends from the base of the electrical connector. In the preferred embodiment of the invention the securing means is triangular shaped with the base of the triangle adjacent to the support member with one side of the triangle engaging the frame opening of the chassis.

The objects, advantages and novel features of the present invention are apparent from the following detailed description when read in conjunction with the appended claims and attached drawings.

DESCRIPTION OF THE PREFERRED EMBODIMENT

Figure 1:
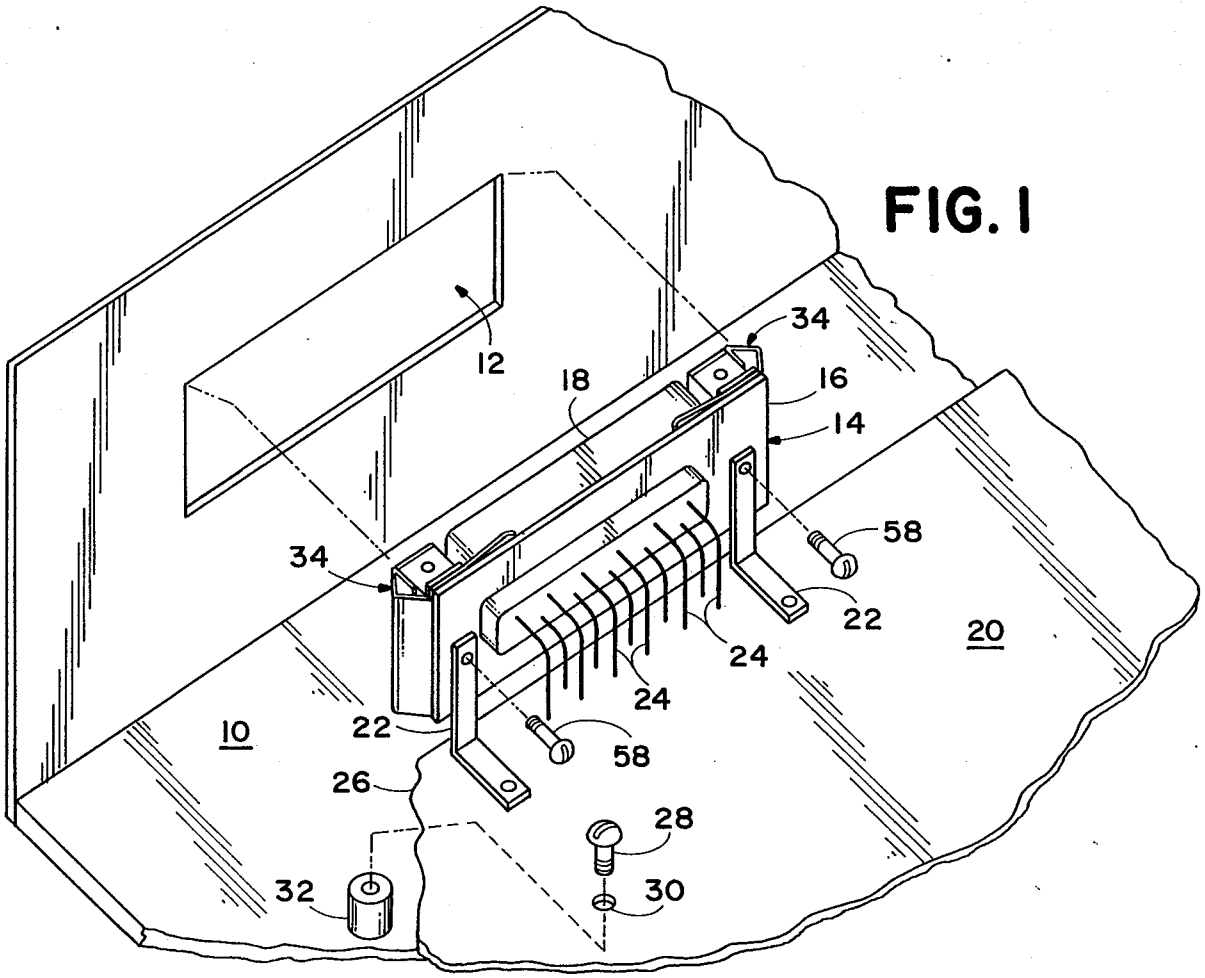
FIG. 1 is a perspective view showing an electrical connector incorporating the grounding clip and fastening apparatus of the present invention.

Referring to FIG. 1, there is shown an electronic equipment chassis 10, such as used for a computer, display terminal, workstation, or the like. Chassis 10 has an opening 12 therein for receiving an electrical connector 14, such as a D-type subminiature connector or the like. Connector 14 has an electrically conductive base 16 and a raised conductor portion 18 having either male or female electrical contacts therein. Electrical connector 14 is mounted on a circuit board 20 using brackets 22 and conductor leads 24. Brackets 22 are electrically conductive and provide electrical continuity between the base 16 of conductor 14 and a ground plane 26 on circuit board 20. Circuit board 20 is secured to chassis 10 by screws 28 passing through circuit board vias 30 and engaging circuit board mounting posts 32 on chassis 10. The circuit board mounting posts 32 provide the electrical connectivity between the ground plane 26 of the circuit board 20 and the chassis 10.

Figure 2:
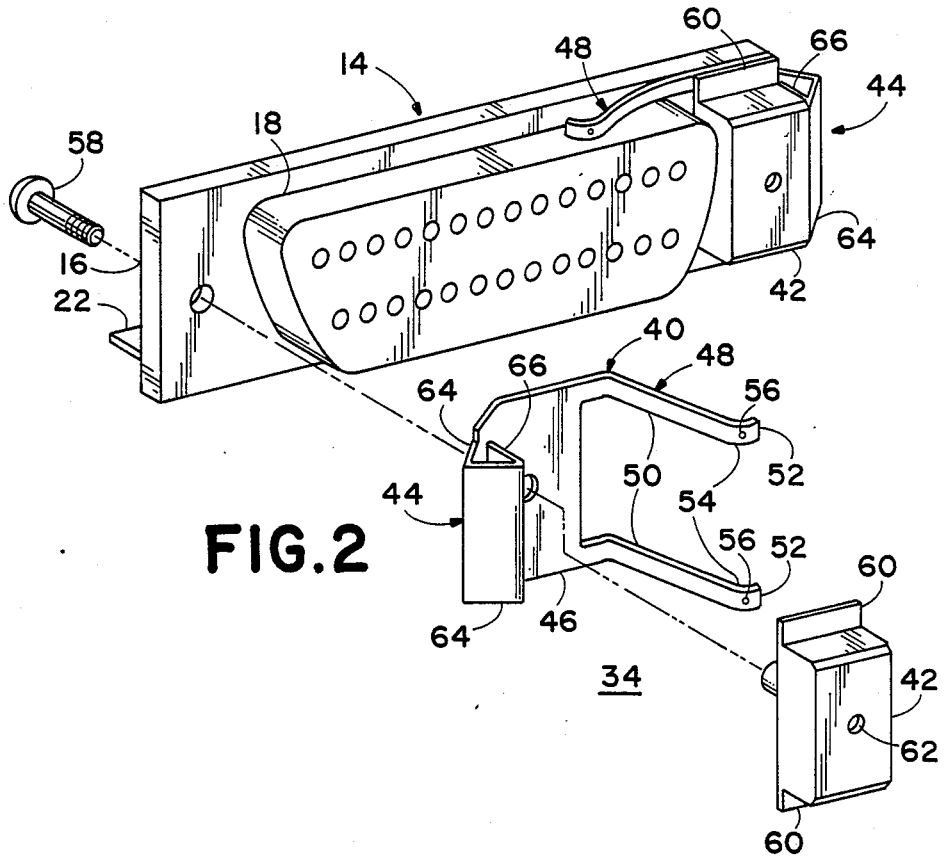
FIG. 2 is an exploded, perspective view of the grounding clip and fastening apparatus of the present invention.

A grounding clip and fastening apparatus 34 is positioned on each end of the electrical connector 14 to secure it into the frame opening 12 of chassis 10. The fastening apparatus 34 is shown in greater detail in the exploded, perspective view of FIG. 2. The grounding clip and fastening apparatus 34 has an electrically conductive member 40 captured between a support member 42 and the base 16 of the electrical connector 14. A fastening member 44 is integrally securing the connector 14 into the frame opening 12. The electrically conductive member 40 has a base portion 46 positioned on the base 16 adjacent the raised connector portion 18 of connector 14. Integrally formed to the base portion 46 and extending along the sides of the raised connector portion 18 are electrically conductive spring biased fingers 48. Each finger 48 is formed with a first arm 50 angularly depending from the base 16 of the electrical connector 14 and a second arm 52 depending back toward the base forming an apex 54 in the finger at the junction of the two arms. A protrusion 56 is formed at the apex 54 that wipingly engages the chassis 10 as the connector 14 is inserted into the frame opening 12. The support member 42 is an injected molded plastic part fixedly positioned on the base 16 of conductor 14. The support member 42 provides strain relief for the fastening member 44/base portion 46 interface. However, a more commonly used 4-40 spacer nut can be employed without departing from the teachings of the invention. The support member 42 is secured to the electrical connector 14 using a screw 58 passing through the base 16, or similar types of securing means such as heat staking. The support member 42 has shoulders 60 formed adjacent to its base that are captured between the base 16 and the chassis 10 when connector 14 is secured in frame opening 12. The shoulders 60 provide a firm seat for the electrical connector 14 preventing excessive connector 14 rotation. A threaded aperture 62 is formed in the top of support structure 42 for receiving a mounting screw associated with a mating electrical connector or cable.

The fastening member 44 extends from the base portion 46 of the electrically conductive member 40 opposite the spring biased fingers 48. The fastening member 44 is triangular shaped with the base 66 of the triangle being normal to the electrical connector base 16 and parallel to one side of the support member 42. The sides 64 of the triangle extend away from the support member 42 with one side of the triangle integrally connected to the base portion 46 and the other connected to the base 66.

As the electrical connector 14 is inserted into the frame opening 12, compressive and translation forces are applied to the triangular fastening member 44, which compresses the overall triangular shape of the fastener. The fastening member 44 is compressed until the apex of the triangle is inserted past the frame opening whereupon the spring bias action of the fastening member 44 counteracts the applied forces to expand the triangles shape and engages one of the triangle sides 64 in the frame opening 12.

Figure 3:
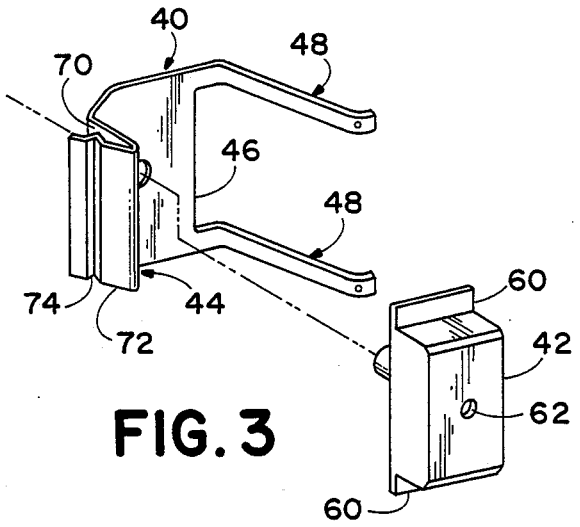
FIG. 3 is an alternative embodiment of the grounding clip and fastening apparatus of the present invention.

An alternative configuration for the fastening member 44 is shown in FIG. 3. The fastening member 44 is formed from the electrically conductive member 40 and has a first arm 70 extending from the base portion 46 normal to the base 16 of electrical connector 14 and parallel to one side of the support member 42. A second arm 72 is recumbently folded with respect to the first arm 70 forming an acute angle there between. A recumbently folded structure is defined for this purpose as having a surface tending to rest upon the surface from which it extends. The second arm 72 is spring biased and has a synclinal depression 74 formed therein that is normal to the plane containing the acute angle. A synclinal depression is one where the sides of the depression dip inward to a central axis. The synclinal depression 74 engages the chassis frame 10 during the insertion of the electrical connector 14 into the frame opening 12.

The grounding clip and fastening apparatus 34 of the present invention provides a quick and easy method of securing the electrical connector 14 into the frame opening 12 while at the same time providing a good ground connection between the chassis 10 and the electrical connector base 16 for preventing electro-magnetic interference (EMI). The EMI protection is provided by the spring biased fingers 48 on the electrically conductive member 40 engaging the chassis 10 and the electrical connector base 16 through the large electrically conductive surface area provided by the base portion 46. By maintaining the distance between the spring fingers 48 on each side of the raised connector portion 18 within one inch, the present invention provides EMI shielding for electrical connectors of varying lengths. In addition, circuit boards containing multiple electrical connectors can be easily and quickly assembled or disassembled in a chassis using this invention. Once the grounding clip and fastening apparatus 34 are installed on the electrical connectors and the connectors 14 are mounted on the circuit board 20, the circuit board 20 can be placed in the chassis and the electrical connectors 14 aligned and inserted into the frame openings 12 in the chassis 10. With the electrical connectors inserted in the frame openings, the circuit board 20 is secured to the chassis 10 via screws 28 passing through the circuit board vias 30 and into mounting posts 32. To remove the circuit board 20, only the screws 28 need to be removed from the circuit board.

A ground clip and fastening apparatus for an electrical connector has been described wherein an electrically conductive member is formed with spring biased fingers, a base portion, and fastening member. The spring biased fingers in conjunction with the electrically conductive surface of the base portion provides good EMI shielding between the electrical connector base and a chassis frame when the connector is inserted into the frame opening. The fastening member provides a quick and easy way of securing the electrical connector in frame opening in a chassis. A support member is fixedly positioned on the electrical connector base and captures the electrically conductive member therebetween. The support member provides strain relief for the fastening means and prevents excessive connector rotation. These and other aspects of the present invention are set forth in the appended claims.

We claim:

1. For an electrical connector having a base and a raised connector portion with side and end surfaces, an integral grounding clip and fastening apparatus for securing the electrical connector in a frame opening comprising:

a support member fixedly positioned on the base of the electrical connector adjacent to an end surface of the raised connector portion;

an electrically conductive member having a base portion captured between the support member and the base of the electrical connector, the base portion being in electrical contact with the base of the electrical connector and having integrally formed spring biased fingers angularly depending from the base of the electrical connector, with at least one finger extending along each side surface of the raised connector portion and having an end portion depending toward the base of the electrical connector, the electrical conductive member providing electrical continuity between the frame and the electrical connector; and means for securing the electrical connector in the frame opening, the securing means integrally formed from the electrically conductive member and depending from base portion of the electrically conductive member opposite the spring biased fingers.

2. The integral grounding clip and fastening apparatus of claim 1 wherein the securing means further comprises a first arm normal to the base portion and a second arm recumbently folded with respect to the first arm forming an acute angle there between, the second arm being spring biased and having a synclinal depression therein normal to the plane containing the acute angle, the synclinal depression engaging the frame during insertion of the electrical connector into the frame opening.

3. The integral grounding clip and fastening apparatus of claim 1 wherein the securing means further comprises the electrically conductive member formed into an approximate triangular shape with the triangle being spring biased and having a base normal to the base of the electrical connector and sides engaging the frame opening.

4. The integral grounding clip and fastening apparatus of claim 1 further comprising a second electrically conductive member captured between a second support member fixedly positioned on the base of the electrical connector adjacent to an opposing end surface of the raised connector portion with a second securing means integrally formed and depending from the second electrical connective member.

5. The integral grounding clip and fastening apparatus of claim 1 wherein the spring loaded fingers further comprises a protrusion formed at the apex of each finger for wipingly engaging the frame during insertion of the electrical connector into the frame opening.

6. The integral grounding clip and fastening apparatus of claim 1 wherein the support member further comprises side surfaces having a first surface providing bearing support for the securing means and opposing surfaces normal to the first surface having protrusions formed thereon adjacent to the base of the electrical connector providing a firm seat for the electrical connector when secured in the frame opening preventing excessive connector rotation.

7. The integral grounding clip and fastening apparatus of claim 1 wherein the support member further comprises a threaded aperture for receiving a mounting screw associated with a second electrical connector.

8. The integral grounding clip and fastening apparatus of claim 1 wherein the support member is fixedly positioned to the base of the electrical connector by a screw.

9. A circuit board assembly for use in a chassis having a frame opening comprising:

a circuit board fixedly positioned on the chassis having a ground plane in electrical contact with the chassis;

an electrical connector affixed to the circuit board, the electrical connector having a base and a raised connector portion with side and end surfaces, the base of the electrical connector being in electrical contact with the ground plane of the circuit board;

a support member fixedly positioned on the base of the electrical connector adjacent to an end surface of the raised connector portion;

an electrically conductive member having a base portion captured between the support member and the base of the electrical connector, the base portion being in electrical contact with the base of the electrical connector and having integrally formed spring biased fingers angularly depending from the base of the electrical connector, with at least one finger extending along each side surface of the raised connector portion and having an end portion depending toward the base of the electrical connector, the electrical conductive member providing electrical continuity between the frame and the electrical connector; and means for securing the electrical connector in the frame opening, the securing means integrally formed from the electrically conductive member and depending from base portion of the electrically conductive member opposite the spring biased fingers.

10. The integral grounding clip and fastening apparatus of claim 9 wherein the securing means further comprises a first arm normal to the base portion and a second arm recumbently folded with respect to the first arm forming an acute angle there between, the second arm being spring biased and having a synclinal depression therein normal to the plane containing the acute angle, the synclinal depression engaging the frame during insertion of the electrical connector into the frame opening.

11. The integral grounding clip and fastening apparatus of claim 9 wherein the securing means further comprises the electrically conductive member formed into an approximate triangular shape with the triangle being spring biased and having a base normal to the base of the electrical connector and sides engaging the frame opening.

12. The integral grounding clip and fastening apparatus of claim 9 further comprising a second electrically conductive member captured between a second support member fixedly positioned on the base of the electrical connector adjacent to an opposing end surface of the raised connector portion with a second securing means integrally formed and depending from the second electrical connective member.

13. The integral grounding clip and fastening apparatus of claim 9 wherein the spring loaded fingers further comprises a protrusion formed at the apex of each finger for wipingly engaging the frame during insertion of the electrical connector into the frame opening.

14. The integral grounding clip and fastening apparatus of claim 9 wherein the support member further comprises side surfaces having a first surface providing bearing support for the securing means and opposing surfaces normal to the first surface having protrusions formed thereon adjacent to the base of the electrical connector providing a firm seat for the electrical connector when secured in the frame opening preventing excessive connector rotation.

15. The integral grounding clip and fastening apparatus of claim 9 wherein the support member further comprises a threaded aperture for receiving a mounting screw associated with a second electrical connector.

16. The integral grounding clip and fastening apparatus of claim 9 wherein the support member is fixedly positioned to the base of the electrical connector by a screw.

17. A method of assembling a circuit board in an electrically conductive chassis having an opening therein for accepting an electrical connector having a base and a raised connector portion with side and end surfaces, the steps comprising:

fixedly positioning a support member on the base of the electrical connector adjacent to an end surface of the raised connector portion;

capturing an electrically conductive member having a base portion between the support member and the base of the electrical connector, the base portion being in electrical contact with the base of the electrical connector and having integrally formed spring biased fingers angularly depending from the base of the electrical connector, with at least one finger extending along each side surface of the raised connector portion and having an end portion depending toward the base of the electrical connector, the electrical conductive member providing electrical continuity between the frame and the electrical connector;

affixing the electrical connector to the circuit board, the base of the electrical connector being in electrical contact with he ground plane of the circuit board;

securing the electrical connector in the frame opening, the securing means integrally formed from the electrically conductive member and depending from base portion of the electrically conductive member opposite the spring biased fingers; and fixedly positioning the circuit board on the chassis, the ground plane of the circuit board being in electrical contact with the chassis.

* * * * *